US006135304A

United States Patent [19]

Wyslotsky

[11] Patent Number: 6,135,304

[45] Date of Patent: Oct. 24, 2000

[54] POLYMERIC PACKAGE WITH REMOVABLE NON-PEELABLE FLANGE OPENING ELEMENT

[75] Inventor: Ihor Wyslotsky, Chicago, Ill.

[73] Assignee: Redex Packaging Corporation, Schaumburg, Ill.

[21] Appl. No.: 09/296,742

[22] Filed: Apr. 23, 1999

[51] Int. Cl.[7] ..... B65D 17/40

[52] U.S. Cl. ..... 220/276; 220/359.1; 220/359.4; 428/35.7; 428/36.7

[58] Field of Search ..... 220/270, 276, 220/359.1, 359.2, 359.3, 359.4; 428/34.2, 35.7, 36.6, 36.7; 215/347; 229/123.2

[56] References Cited

U.S. PATENT DOCUMENTS

| | | | |
|---|---|---|---|
| 2,923,404 | 2/1960 | Adell | 206/525 |
| 2,941,660 | 6/1960 | Tupper | 229/123.2 X |
| 2,998,158 | 8/1961 | Tupper | 220/276 |
| 3,183,800 | 5/1965 | Farrell et al. | 229/123.2 X |
| 4,759,463 | 7/1988 | Mazoin | 220/270 |
| 4,858,780 | 8/1989 | Odaka et al. | 220/359.2 X |
| 5,178,293 | 1/1993 | Suzuki et al. | 220/359.4 |
| 5,180,599 | 1/1993 | Feldmeier | 220/359.1 X |
| 5,314,733 | 5/1994 | Saito et al. | 428/36.6 |
| 5,429,833 | 7/1995 | Wyslotsky | 220/276 X |
| 5,632,133 | 5/1997 | Wyslotsky | 53/433 |

FOREIGN PATENT DOCUMENTS

| | | | |
|---|---|---|---|
| 2577897 | 8/1986 | France | 229/123.2 |
| 2040267 | 8/1980 | United Kingdom | 220/276 |

*Primary Examiner*—Allan N. Shoap
*Assistant Examiner*—Joe Merek
*Attorney, Agent, or Firm*—Hill & Simpson

[57] ABSTRACT

Improved polymeric packages with removable non-peelable flange portions of the present invention comprise clamshell packages having a removable and non-peelable package sealing mechanism, which mechanism comprises lines of reduced strength disposed within respective more rigid outside polymeric lid and container layers, which lines of reduced strength do not penetrate the inner disposed less rigid polymeric lid and container layers, whereby the respective lid and container flange portions disposed laterally exterior of the lines of reduced strength can be removed to the package—easily neatly efficiently and without generation of particulate matter.

16 Claims, 1 Drawing Sheet

POLYMERIC PACKAGE WITH REMOVABLE NON-PEELABLE FLANGE OPENING ELEMENT

BACKGROUND OF THE INVENTION

1. Field of the Invention

The present invention relates in general to improved polymeric packages having centrally disposed product containing portions, and more particularly relates to improved polymeric packaging of the type having a removable flange for opening a hermetically sealed, recloseable package.

2. The Prior Art

The prior art has included a wide variety of polymeric packages having recloseable features. Many of these packages are initially provided in a sealed condition, which have necessarily utilized a removable sealing mechanism to initially open the package.

Strippable mechanisms of prior art are set forth in, for example, U.S. Pat. No. 5,079,095, which discloses a peelable portion of a package lid, and which functions by delaminating polymeric webs.

U.S. Pat. No. 5,546,731 likewise depicts a polymeric package having an exteriorly disposed strippable or peelable package opening feature. This sealed package is also opened by delaminating one flange element from another.

Similar delaminating and/or strippable elements are set forth in the prior art, such as for example in U.S. Pat. No. 5,044,495 at FIG. 5.

Frequently in the prior art, polymeric packages of this kind have been hermetically sealed, such as for containing food or medical products which must be maintained in sterile condition. However, hermetically sealed packages with peelable seals have a tendency to open and/or leak readily during ambient barometric pressure drops or during air shipments, as well as transportation through high mountain passes. In that regard, peelable seals will open at 200–600 grams per lineal inch of full force. Higher peeling force materials have been attempted to cure this problem of premature seal fracture, but have often resulted in strip breakage during planned opening. It is believed that the mechanism of failure is such that when the ambient atmospheric pressure is reduced, the inner pressure of the package head space will burst the peelable seal open, causing comestible product contamination and spoilage, or contamination of sterile medical products.

In addition, the packages with an exteriorly disposed strippable or peelable package opening feature must be made from polymers that remain elastic at refrigerated temperatures of 32° to 42° F. (0° to 5.5° C.) without becoming brittle, or otherwise the removable strip will break. Polymers which will remain at refrigerated temperatures are more expensive and may have to contain plasticizers which are not desirable for packaging foods and medical devices.

SUMMARY OF THE INVENTION

In view of the above defects and efficiencies of the prior art, it is a material object of the improved polymeric package with removable and non-peelable flange of the present invention to provide matched lines of reduced strength (such as, for example, by scoring, slitting, indenting, etc.) of the two halves of the package interior of a more permanent and nonpeelable seal portion. In particular, since both the flanges of the lid and of the container are removed together during the opening procedure, permanently fused polymers may be employed on the opposing flanges exteriorly of the opening mechanism. By welding these flanges securely together, the package is rendered functional for encapsulating and hermetically sealing comestible products and/or sensitive medical products therewithin. The selected sealants for use in connection with the improved polymeric package of the present invention can withstand at least approximately 1200 grams per lineal inch of pull without affecting the ease of opening the package.

Hermetically sealed packages which are designed for preserving food or pharmaceuticals, or for keeping medical devices in sterility, rely on package integrity to maintain its contents clean and isolated from the contaminants and hazards of the environment. This package integrity can be achieved by welding the two halves together. As the opening of the hermetically welded polymers package poses a severe difficulty to the user, all such designs in the past have failed. In order to overcome this obstacle, it is desirable to provide for the package user a design that would offer a reliable and easy opening feature, similar to the opening tab on the aluminum beverage can. Since polymers in general do not offer the ductility and flow characteristics of metals like aluminum, scoring for making a tear away tab of such packages is not feasible.

The method hereof used for providing a tear away seal for hermetically sealed packages without compromising their integrity and capability to protect the contents consists of a new method of scoring of selected polymers. The outer layers of each half of the package consist of rigid, non-extensible polymers, and the inside layers consist of thin, extensible co-extruded polymers that contain layers designed to protect the contents. This thin extensible layer is mounted to the heavy rigid layer with a flexible, permanent polymeric adhesive which absorbs minor displacements of the rigid heavy gauge polymer during scoring.

The scoring of the rigid, non-extensible polymer is done with a penetrating scoring tool. The tip of the tool impresses an angular score line into the rigid polymer to within approximately 50 micron from the surface of the thin extensible polymer. As the scoring tool penetrates the rigid, non extensible polymer, any lateral displacements are absorbed by the flexible polymeric adhesive between the rigid, non-extensible polymer and the thin extensible polymer. This cushioning prevents any damage to the thin extensible polymer containing the necessary barrier features for protecting the contents of the package.

In addition, the improved polymeric package design of the present invention offers a secure enclosure, which includes a tamper-evident seal, and which may be easily manually opened with a clean separation of the flange.

A further advantage of the removable seal mechanism associated with the improved polymeric package of the present invention is that no debris are formed from peeling of one strip from another, as with certain prior art systems.

The non-particulating opening action of the package makes it particularly suitable for use in clean rooms, such as surgery theaters, electronic and/or precision instrumentation assembly rooms, etc.

A further benefit of the removable seal mechanism of the present invention is that manually challenged persons, who may have only one functioning hand can open and reclose the improved polymeric package of the present invention. In contrast, the peelable seal mechanisms of the prior art require two functional hands in order to open the package.

These and other advantages and benefits of the improved polymeric package with removable and non-peelable flange mechanism of the present invention may be further appreciated by those skilled in the art upon review of the following drawings and detailed description of the preferred embodiments.

DETAILED DESCRIPTION OF PREFERRED EMBODIMENTS

Figure 1:
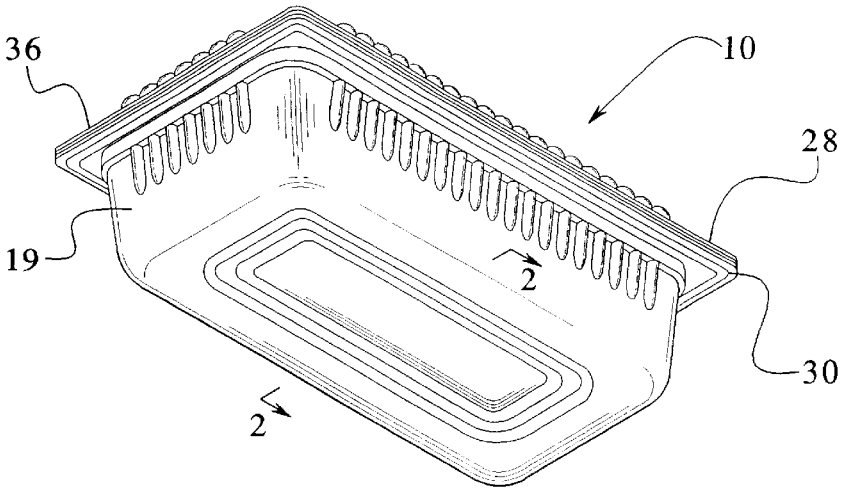
FIG. 1 is a perspective view of the improved polymeric package of the present invention showing centrally disposed product containing areas of both the lid and container portions thereof, and each of which includes a peripherally disposed flange, which flanges are respectively disposed in abutting and sealing relationships.
Figure 2:
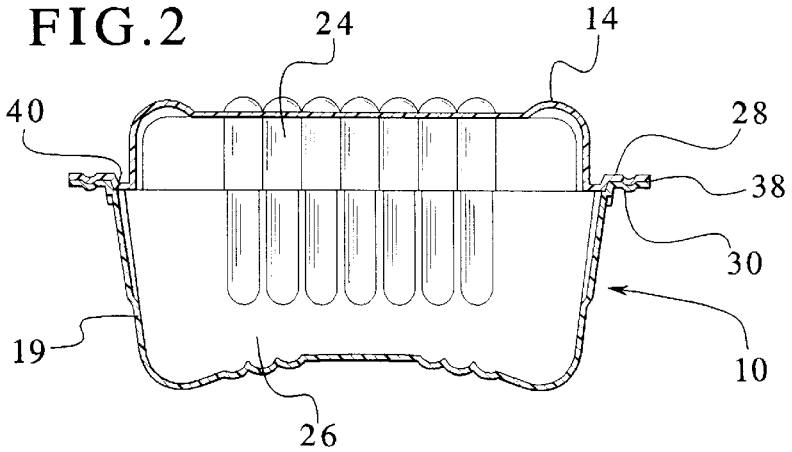
FIG. 2 is a cross-sectional view taken along line 2—2 of FIG. 1 showing the package lid and container portions, and the respective lid and flange elements.

With regard to the drawing, and FIGS. 1 and 2 in particular, an improved polymeric package of the present invention, generally 10 is depicted. Such improved polymeric package 10 includes a removable and nonpeelable package sealing mechanism generally 12.

In particular, the laminated package lid 14 is formed from a more non-extensible rigid outside polymeric layer 16 and a generally substantially thinner less rigid and lower tear strength inside polymeric layer 18. The laminated package container 19 is formed from a more rigid non-extensible outside polymeric container layer 20 and a thinner less rigid and of lower tear strength inside polymeric container layer 22.

The laminated package lid 14 and the laminated container 19 respectively include central product enclosing lid and container portions 24, 26 and peripherally disposed lid and container flanges 28, 30. The lid and container flanges 28, 30 are disposed in abutting sealing relationship. The embodiment of FIG. 3 has a nonpeelable sealant 32 sealably disposed therebetween about the entirety of the circumference of the respective flanges 28, 30 to form sealed package 10.

The more rigid outside polymeric lid layer 16 and the more rigid outside polymeric container layer 20 of the lid and container flanges 28, 30 each include lines of reduced strength, here shown for example as slits 34, which are disposed in mating transverse relationship about the entire circumference 36 of the flanges 28, 30.

Figure 4:
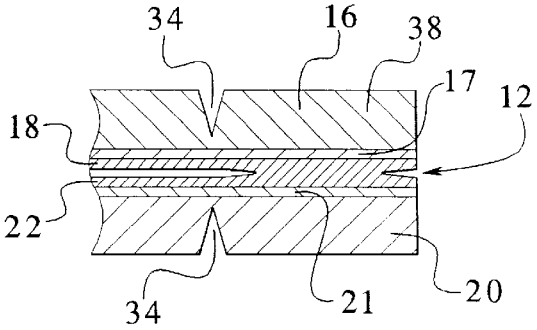
FIG. 4 is another preferred embodiment of the invention hereof showing each of the package container (a) the outer, rigid, non-extensible layer, (b) the intermediate layer consisting of a permanent polymeric adhesive, and (c) the inner disposed layer formed from a thin, extensible polymeric material.

The embodiment of FIG. 4 includes non-extensible outside polymeric layers 16, 20, which are respectively bonded to substantially thinner less rigid and lower tear strength inside polymeric layers 18, 22, by means of a flexible, permanent polymeric adhesive or tie layer 17, 21. According to the present invention, the two inside polymeric layers 18, 22 are fused together exteriorly of the location of slits 34, 34.

The removable and nonpeelable flange sealing mechanism 12 of the present intention functions to permit the respective flanges 28, 30 to be manually gripped, and with the sealant containing exterior portion 38 to be manually removed by fracturing the flanges 28, 30 along the lines of reduced strength (slits 34, 34) thereby to open package 10.

Figure 3:
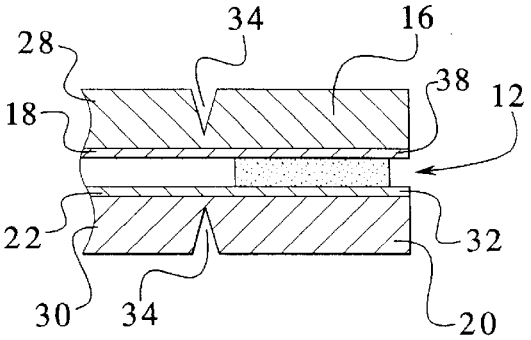
FIG. 3 is an enlarged cross sectional view of one embodiment of the removable and non-peelable sealing mechanism of the present invention, showing the respective outside more rigid layers of the lid and package, and the inside less rigid layers of the lid and the container, with respective lines of reduced strength (here, shown as slits) disposed within the respective more rigid outside polymeric layers to provide a removable, tamper-evident, and essentially debris free seal portion.

The respective lines of reduced strength as shown in FIG. 3 may comprise in some preferred embodiment slits 34, 34 cut into the respective more rigid outside polymeric lid layer 16 and the more rigid outside polymeric container layer 20. The slits 34, 34 may be cut to a depth to within 50 microns from the extensible less rigid layers 18 and 22 of the respective more rigid layers 16, 20. Slits 34, 34 are formed by a scoring tool which forms slits 34, 34 having generally angled resulting walls with the angle thereof selected according to the properties of the polymeric materials used.

In preferred embodiments hereof, the more rigid outside polymeric layers may comprise clear thermoformible rigid polyester, polyvinyl chloride, polystyrene, modified polystyrenes, polypropylene, polycarbonate, polyacrylonitriles, acrylo-butyl styrenes, or other suitable polymeric materials. The less rigid inside polymeric layers may comprise extensible co-extruded polymers, such as (1) a tie layer adhering to a more rigid polymer/ethyl vinyl alcohol/tie layer/polyolefin, (2) a tie layer/polypropylene/tie layer/polyolefin, or (3) a tie layer/ethyl vinyl alcohol/tie layer/nylon/tie layer/polyolefin, or similar structures.

In preferred embodiments, the less rigid extensible inside polymeric lid and container layers may or may not, according to the use, comprise barrier layers, of known composition, such as nylon, polyvinyl chloride, ethyl vinyl alcohol, and others.

Of course, any of the polymeric materials hereof may be pigmented or clear.

In preferred embodiments, the respective inside less rigid polymeric layers and the permanent adhesive layers may be co-extruded.

Preferred nonpeelable sealants 32 and 38 for use in connection with the improved polymeric package 10 of the present invention may include polyolefin-based hot melt adhesives 42, and should preferably withstand the force in excess of 1,200 grams per lineal inch of pull force.

The package elements as shown in FIG. 1 may further comprise matable reclosure elements 40.

Although the present invention has been described with reference to a specific embodiment, those of skill in the art will recognize the changes may be made thereto without departing from the scope and spirit of the invention as set forth in the appended claims.

What is claimed is:

1. An improved polymeric package with removable nonpeelable flange comprising:

a laminated package lid formed from a more rigid essentially non-extensible outside polymeric lid layer and a less rigid extensible inside polymeric lid layer;

a laminated package container formed from a more rigid essentially non-extensible outside polymeric container layer and a less rigid extensible inside polymeric container layer;

said laminated package lid and said laminated container respectively including central product enclosing lid and container portions, and peripherally disposed lid and container flanges;

said lid and container flanges disposed in abutting sealing relationship;

a respective lateral portion of said respective flanges disposed about substantially the entirety of the circumference of said respective flanges to form a sealed package;

said more rigid outside polymeric lid layer and said more rigid outside polymeric container layer of said lid and container flanges, including superimposed, parallel lines of reduced strength, spaced from the inside layer, disposed about the circumference of said flanges and interior of said sealed relationship, whereby said respective flanges can be manually gripped and the portion thereof which is exterior of said lines of reduced strength manually removed by fracturing and tearing away said flanges along said lines of reduced strength to open said package.

2. The improved package of claim 1 wherein said outside polymeric lid layer and said inside polymeric lid layer are joined by a flexible polymeric adhesive layer.

3. The improved package of claim 1 wherein said outside polymeric container layer and said inside polymeric container layer are joined by a flexible polymeric adhesive layer.

4. The improved package of claim 1 wherein said respective inside polymeric lid and container layers are disposed in said sealed relationship by means of an adhesive disposed laterally exteriorly of said lines of reduced strength.

5. The improved package of claim 1 wherein said lines of reduced strength comprise slits cut into said respective more rigid outside polymeric lid layer and said more rigid outside polymeric container layer.

6. The improved package of claim 5 wherein said slits are cut to a depth of approximately within 50 micron from the extensible less rigid layer of said respective more rigid layers.

7. The improved package of claim 5 wherein said respective slits do not penetrate said respective less rigid inside polymeric lid and container layers.

8. The improved package of claim 1 wherein said more rigid inside polymeric container layer is selected from the group comprising thermoformable rigid polyester, polyvinyl chloride polystyrene, modified polystyrenes, polypropylene, polycarbonate, polyacrylonitriles and acrylo-butyl styrenes.

9. The improved package of claim 1 wherein said less rigid outside polymeric container layer comprises the structure of two or more co-extruded polymers.

10. The improved package of claim 9 wherein said structure of two or more co-extruded polymers comprises a tie layer with an ethyl vinyl acetate receptor to permit flexible adhesion to a more rigid polymer barrier.

11. The improved package of claim 10 wherein said more rigid polymer barrier is selected from the group consisting of nylon, polyvinyledine chloride, and ethyl vinyl alcohol.

12. The improved package of claim 1 wherein said more rigid polymeric barrier is bonded to an interstitial tie layer, which is further bonded to a polyolefin sealant.

13. The improved package of claim 1 wherein said respective less rigid inside polymeric lid and container layers further comprises barrier layers.

14. The improved package of claim 1 wherein said non-peelable sealant comprises co-extruded polymers having inseparable individual layers with outside low melt polyolefinic permanent low melt point sealant layer facing each other.

15. The improved package of claim 1 wherein said non-peelable sealant will withstand a force of approximately 1200 grams per lineal inch of pull.

16. The improved package of claim 1 wherein said laminated package lid and said laminated package container further comprise matable reclosure elements.

* * * * *